US007246548B2

(12) United States Patent
Kash

(10) Patent No.: US 7,246,548 B2
(45) **Date of Patent: *Jul. 24, 2007**

(54) WELL PERFORATING GUN

(76) Inventor: Edward Cannoy Kash, 11660 Brittmore Park Dr., Houston, TX (US) 77041

( * ) Notice: Subject to any disclaimer, the term of this patent is extended or adjusted under 35 U.S.C. 154(b) by 77 days.

This patent is subject to a terminal disclaimer.

(21) Appl. No.: 11/134,730

(22) Filed: May 19, 2005

(65) Prior Publication Data

US 2005/0217842 A1 Oct. 6, 2005

Related U.S. Application Data

(63) Continuation-in-part of application No. PCT/US04/17437, filed on Jul. 1, 2004.

(51) Int. Cl.
*E21B 43/116* (2006.01)

(52) U.S. Cl. ..... 89/1.15; 102/313; 175/2

(58) Field of Classification Search ..... 89/1.15; 102/310, 311, 312, 331; 166/297; 175/2, 175/3, 3.5, 4, 4.51, 4.6, 4.53
See application file for complete search history.

(56) References Cited

U.S. PATENT DOCUMENTS

| | | | | |
|---|---|---|---|---|
| 2,649,046 | A | 8/1953 | Davis | 102/310 |
| 2,750,885 | A | 6/1956 | Schlumberger | 175/4.6 |
| 2,980,017 | A | 4/1961 | Castel | 175/4.6 |
| 4,523,649 | A | 6/1985 | Stout | 175/4.51 |
| 4,850,438 | A * | 7/1989 | Regalbuto | 175/4.56 |
| 4,889,183 | A | 12/1989 | Sommers | 166/66 |
| 4,919,050 | A * | 4/1990 | Dobrinski et al. | 102/307 |
| 5,095,999 | A | 3/1992 | Markel | 175/4.6 |
| 5,775,426 | A | 7/1998 | Snider | 166/308.1 |
| 5,960,894 | A | 10/1999 | Lilly | 175/4.6 |
| 6,336,506 | B2 | 1/2002 | Wesson | 166/308.1 |
| 6,347,673 | B1 | 2/2002 | Dailey | 175/4.6 |
| 6,386,110 | B1 * | 5/2002 | Landman et al. | 102/331 |
| 6,520,258 | B1 | 2/2003 | Yang | 166/297 |
| 6,554,081 | B1 | 4/2003 | Brooks | 175/4.54 |
| 6,672,405 | B2 * | 1/2004 | Tolman et al. | 175/4.52 |
| 6,679,327 | B2 | 1/2004 | Sloan | 166/297 |
| 6,732,798 | B2 | 5/2004 | Johnson | 166/297 |
| 6,865,792 | B2 * | 3/2005 | Kash | 29/455.1 |
| 6,865,978 | B2 * | 3/2005 | Kash | 89/1.15 |
| 6,926,096 | B2 * | 8/2005 | Kash | 175/2 |
| 6,962,203 | B2 * | 11/2005 | Funchess | 166/297 |
| 6,991,044 | B2 * | 1/2006 | Zhang et al. | 175/4.6 |
| 7,000,699 | B2 * | 2/2006 | Yang et al. | 166/255.2 |
| 7,055,421 | B2 * | 6/2006 | Kash | 89/1.15 |
| 7,114,564 | B2 * | 10/2006 | Parrott et al. | 166/255.2 |
| 2002/0134585 | A1 | 9/2002 | Walker | 175/4.51 |
| 2006/0075889 | A1 * | 4/2006 | Walker | 89/1.15 |

* cited by examiner

*Primary Examiner*—James S. Bergin
(74) *Attorney, Agent, or Firm*—Buskop Law Group, PC; Wendy Buskop

(57) ABSTRACT

Embodied herein is a perforating gun wall that withstands short, high energy pulses of an explosion retained within a loading tube with numerous explosive shaped charges. The perforating gun wall includes two or more layers with an impact strength sufficient to maintain the structural integrity of the gun wall without splitting due to the explosion. Each layer is sleeved within the preceding layer forming a sleeved assembly. One or more of the inner layers includes one or more holes aligned with one or more explosive shaped charges. Each layer comprise a defined material property that reduces occurrences of catastrophic failure.

18 Claims, 6 Drawing Sheets

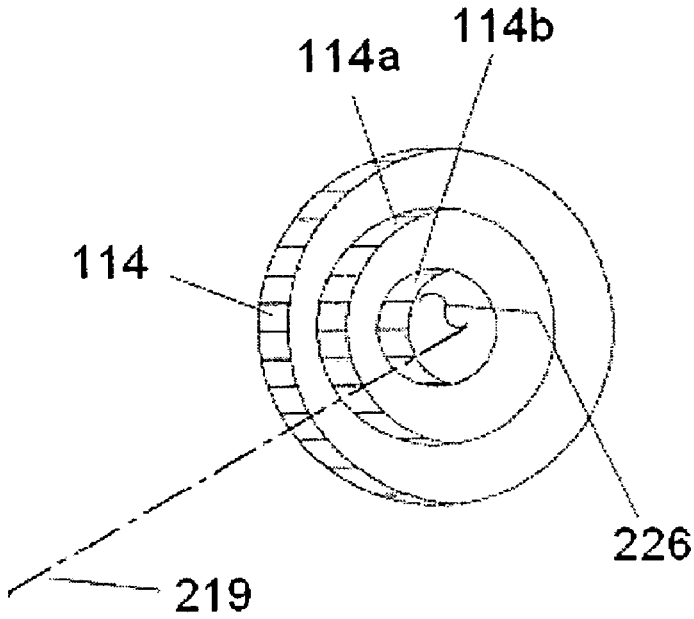
FIGURE 6
FIGURE 7
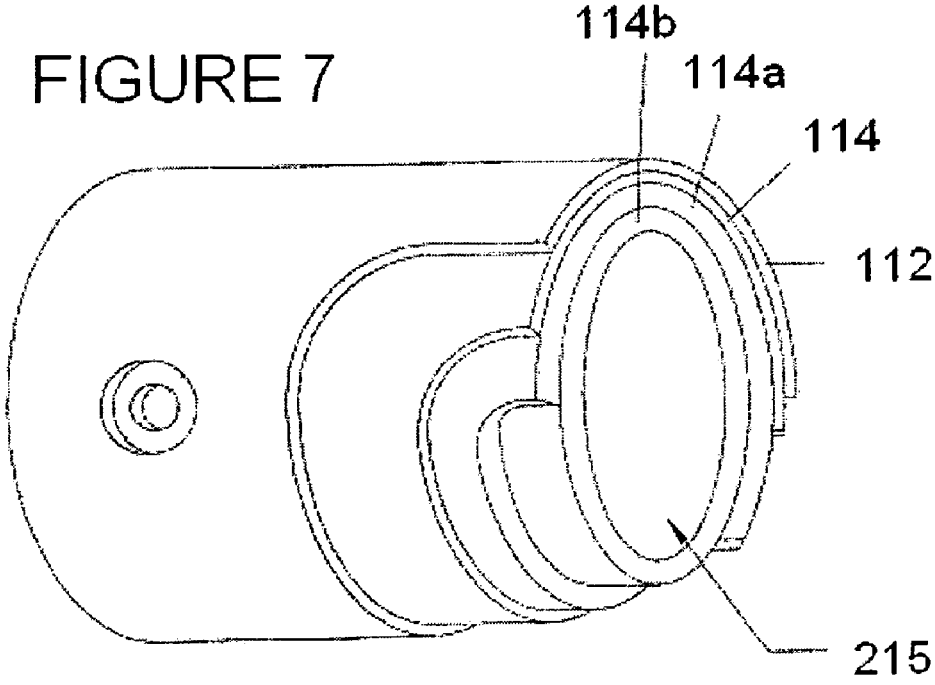

WELL PERFORATING GUN

CROSS REFERENCE TO RELATED APPLICATIONS

The current application is a Continuation-in-Part of co-pending PCT Application Number PCT/US2004/017437 filed on Jul. 1, 2004, based on co-pending U.S. patent application Ser. No. 10/611,188, filed Jul. 1, 2003, entitled, "Well Perforating Gun"; issued U.S. patent Ser. No. 10/610,740, filed Jul. 1, 2003, entitled "Method for Making a Well Perforating Gun" (U.S. Pat. No. 6,865,792, issued on Mar. 15, 2005); and co-pending U.S. patent Ser. No. 10/612,207, filed Jul. 1, 2003, entitled "Method for Using a Well Perforating Gun".

FIELD

The present embodiments relate to well perforating devices.

BACKGROUND

Well completion techniques normally require perforation of the ground formation surrounding the borehole to facilitate the flow if interstitial fluid (including gases) into the hole so that the fluid can be gathered. In boreholes constructed with a casing such as steel, the casing must also be perforated. Perforating the casing and underground structures can be accomplished using high explosive charges. The explosion must be conducted in a controlled manner to produce the desired perforation without destruction or collapse of the well bore.

Hydrocarbon production wells are usually lined with steel casing. The cased well, often many thousands of feet in length, penetrates varying strata of underground geologic formations. Only a few of the strata may contain hydrocarbon fluids. Well completion techniques require the placement of explosive charges within a specified portion of the strata. The charge must perforate the casing wall and shatter the underground formation sufficiently to facilitate the flow of hydrocarbon fluid into the well. The explosive charge must not collapse the well or cause the well casing wall extending into a non-hydrocarbon containing strata to be breached. It will be appreciated by those skilled in the industry that undesired salt water is frequently contained in geologic strata adjacent to a hydrocarbon production zone, therefore requiring accuracy and precision in the penetration of the casing.

The explosive charges are conveyed to the intended region of the well, such as an underground strata containing hydrocarbons, by multi-component perforation gun system ("gun systems," or "gun string"). The gun string is typically conveyed through the cased well bore by means of coiled tubing, wire line, or other devices, depending on the application and service company recommendations. Although the following description of the invention will be described in terms of existing oil and gas well production technology, it will be appreciated that the invention is not limited to those application.

Typically, the major component of the gun string is the "gun carrier" tube component (herein after called "gun") that houses multiple shaped explosive charges contained in lightweight precut "loading tubes" within the gun. The loading tubes provide axial circumferential orientation of the charges within the gun (and hence within the well bore). The tubes allow the service company to preload charges in the correct geometric configuration, connect the detonation primer cord to the charges, and assemble other necessary hardware. The assembly is then inserted into the gun. Once the assembly is complete, other sealing connection parts are attached to the gun and the completed gun string is lowered into the well bore by the conveying method chosen.

The gun is lowered to the correct down-hole position within the production zone, and the chares are ignited producing an explosive high-energy jet of very short duration. This explosive jet perforates the gun and well casing while fracturing and penetrating the producing strata outside the casing. After detonation, the expended gun string hardware is extracted from the well or release remotely to fall to the bottom of the well. Oil or gas (hydrocarbon fluids) then enters the casing through the perforations. It will be appreciated that the size and configuration of the explosive charge, and thus the gun string hardware, may vary with the size and composition of the strata, as well as the thickness and interior diameter of the well casing.

Currently, cold-drawn or hot-drawn tubing is used for the gun carrier component and the explosive charges are contained in an inner, lightweight, precut loading tube. The gun is normally constructed from a high-strength alloy metal. The gun is produced by machining connection profiles on the interior circumference of each of the gun's ends and "scallops," or recesses, cut along the gun's outer surface to allow protruding extensions ("burrs") created by the explosive discharge through the gun to remain near or below the overall diameter of the gun. This method reduces the chance of burrs inhibiting extraction or dropping the detonated gun. High strength materials are used to construct guns because they must withstand the high energy expended upon detonation. A gun must allow explosions to penetrate the gun body, but not allow the tubing to split or otherwise lose its original shape. Extreme distortion of the gun may cause it to jam within the casing. Use of high strength alloys and relatively heavy tube wall thickness has been used to minimize this problem.

Guns are typically used only once. The gun, loading tube, and other associated hardware items are destroyed by the explosive charge. Although effective, guns are relatively expensive. Most of the expense involved in manufacturing guns is the cost of material. These expenses may account for as much as 60% or more of the total cost of the gun. The oil well service industry has continually sought a method or material to reduce the cost while also seeking to minimize the possibility of misdirected explosive discharges or jamming of the expended gun within the well.

Although the need to ensure gun integrity is paramount, efforts have made to use lower cost steel alloys through heat-treating, mechanical working, or increasing wall thickness in lower-strength but less expensive materials. Unfortunately, these efforts have seen only limited success. Currently, all manufacturers of guns are using some variation of high strength, heavy-wall metal tubes.

BRIEF DESCRIPTION OF THE DRAWINGS

The accompanying drawings, which are incorporated in and constitute a part of the specification, illustrate preferred embodiments of the invention. These drawings, together with the general description of the invention above and the detailed description of the preferred embodiments below, serve to explain the principals of the invention.

FIG. 6 depicts multiple holes in multiple layers aligned along a radial axis.

FIG. 7 depicts an embodiment of a perforating gun wall showing the layers with a machined recess.

Figure 1A:
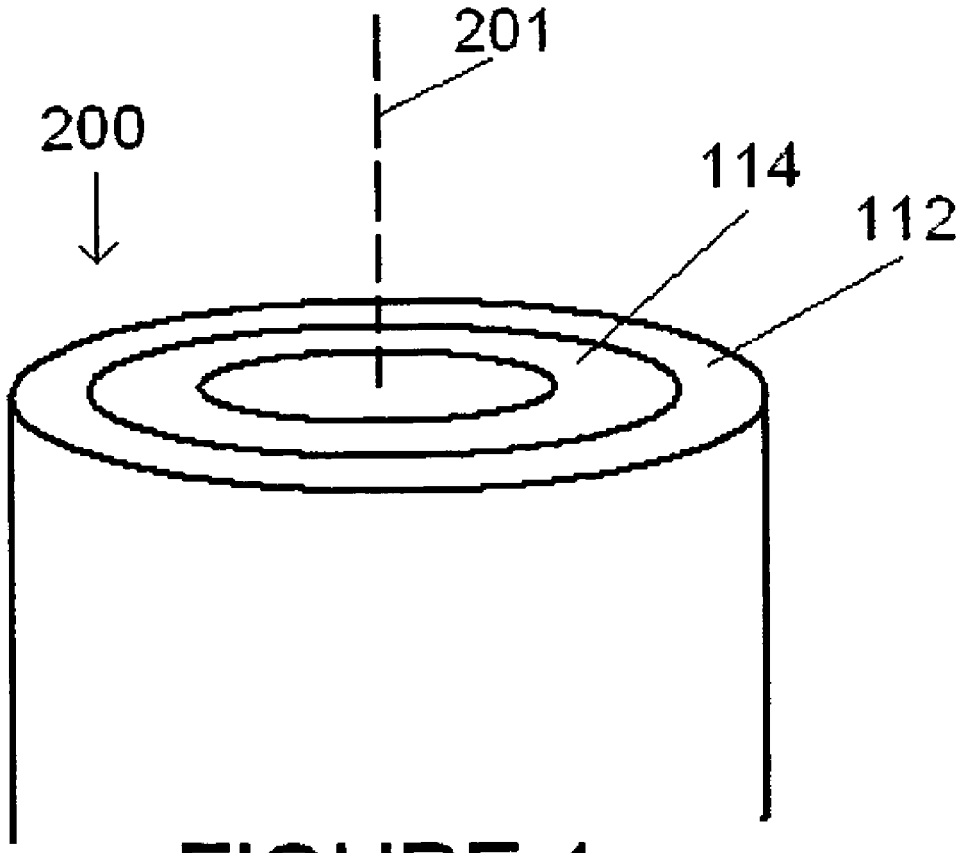
FIG. 1*a* examples an embodiment of a perforating gun wall.

The above general description and the following detailed description are merely illustrative of the subject invention, additional modes, and advantages. The particulars of this invention will be readily suggested to those skilled in the art without departing from the spirit and scope of the invention.

DETAILED DESCRIPTION OF THE EMBODIMENTS

Before explaining the present invention in detail, it is to be understood that the invention is not limited to the particular embodiments herein and it can be practiced or carried out in various ways.

The present embodiments are directed to perforating gun walls that can withstand short, high energy pulses of an explosion retained within a loading tube. The high energy pulses of an explosion come from explosive shaped charges located within the loading tube. The perforating gun wall has a first layer with an impact strength sufficient to maintain the structural integrity of the gun wall without splitting the gun wall. The perforating gun wall has a second layer with an impact strength sufficient to maintain the structural integrity of the gun wall without substantially splitting the gun wall.

The second layer is sleeved within the first layer forming a sleeved assembly. The gun wall can have additional layers sleeved within one another. The inner layers can include one or more holes that are aligned to the explosive charges located in the loading tube.

Each layer of the embodied gun wall has a defined material property that reduces occurrences of catastrophic failure of the perforating gun wall. Examples of the defined material properties include, tensile strength, ductility, elasticity, shock absorption, coefficient of thermal expansion, melting temperature and vaporization temperature.

Splitting causes the gun wall to fail. Failure can hinder the intended perforation of the well casing and the surrounding geologic formation or hinder the removal of the gun from the well. The mechanical property enhancements in the present embodiments allow higher strength, thinner wall perforating guns with high impact resistance and energy absorption. Splitting is caused by the metal separating between the holes or by a longitudinal, orthogonal splitting of a layer. Splitting as defined herein includes cracks, hairline cracks, and fractures. The outer or first layer is solid and must not split. The inner layers can split or crack during use as long as the assembly of the layers stays intact. The current embodiments ensure that splitting does not occur on the outer layer and is minimized in the inner layers. As an example, the metal usable with the outer layer can have a tensile strength between 36 ksi and 400 ksi. The metal can be a chrome alloy, a nickel alloy, a steel alloy, and combinations thereof.

The present embodiments provide a perforating gun wall that is retrievable from a well. Further, the gun wall does not disintegrate in the well itself, therefore providing a significant environmental benefit.

The present embodiments provide a controlled, directional charge for fracturing a well. The controlled, directional charge allows for more precise and efficient drilling of oil and natural gas wells. The present embodiments provide additional safety and protection to the drillers and other equipment used in drilling since the high energy pulses of the explosion is controlled and directional.

Figure 2:
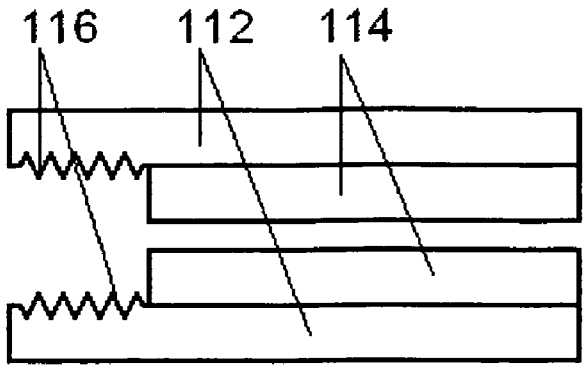
FIG. 2 shows a cross-sectional side view of an embodiment of a perforating gun wall.

With reference to the figures, FIG. 1*a* examples an embodiment of a perforating gun wall 200. The perforating gun wall 200 has a first layer 112 that extends beyond the second layer 114. The layers can be arranged in a slip fit or in an interference fit. FIG. 1*a* shows a longitudinal axis 201 for reference. FIG. 2 shows a cross-sectional side view of this embodiment of the gun wall 200. The extended part of the first layer 112 can have a threaded interior portion 116. The threaded interior portion 116 of the gun wall can engage a sub for drilling.

Figure 1B:
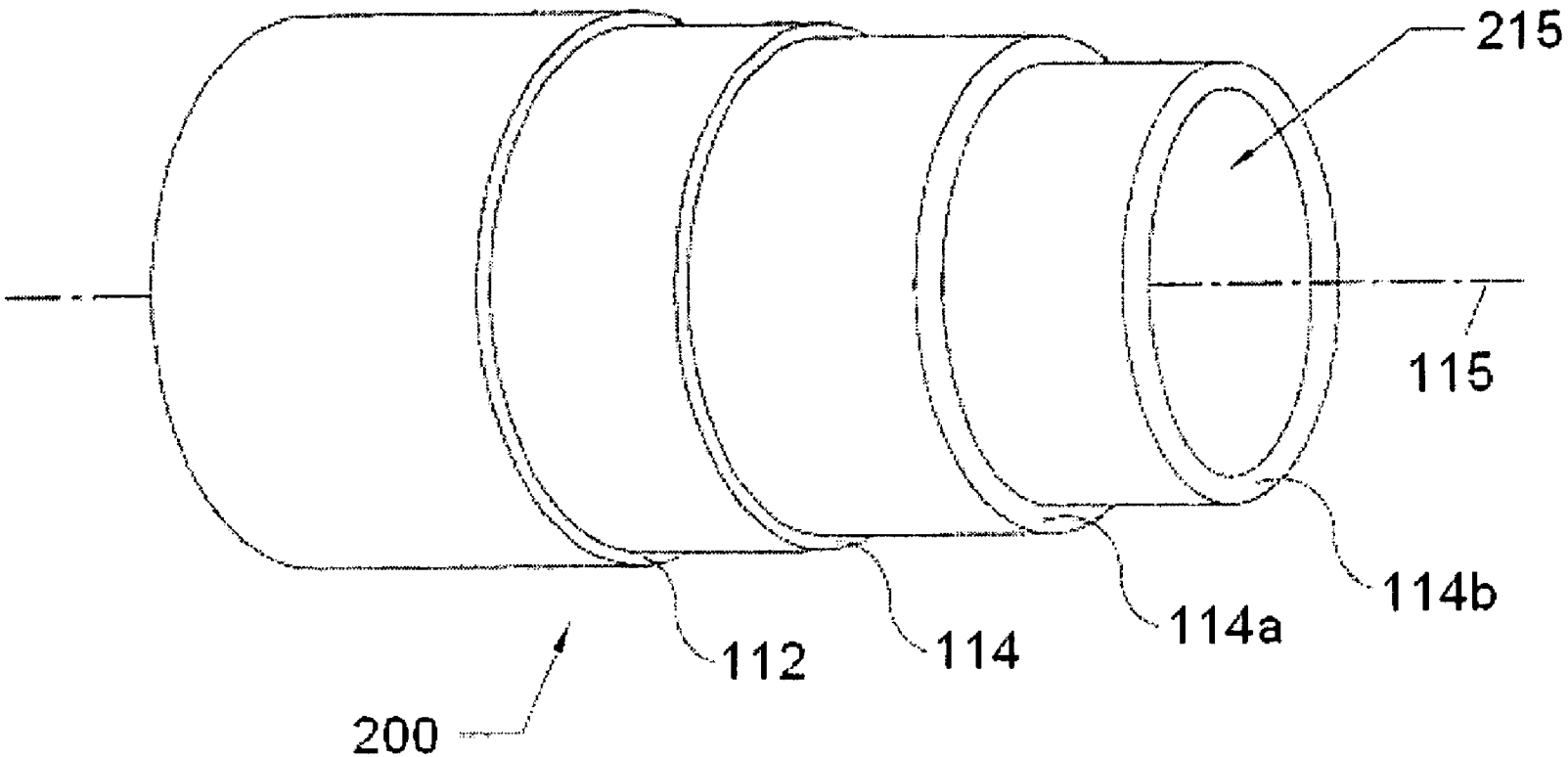
FIG. 1*b* illustrates an embodiment in which the gun wall has four material layers.

FIG. 1*b* illustrates an embodiment in which the gun wall has four material layers 112, 114, 114*a*, and 114*b*. The perforating gun wall 200, however, is not limited to four layers. The multilayer design might consist of "tube-within-a-tube" fabrication or the wrapping of material around the outer surface of an inner tube maintaining a relative uniform radius about a central axis 115. The inner tube defines the area of the tube annulus 215. The tube annulus 215 can be varied within the interior of the gun wall 210 by the addition or removal of layers.

The layers can be wrapped in various orientations and to provide enhanced strength. The wrapping can include braiding, laminations, or woven construction of material. The laminations can consist of other metals or non-metals to obtain desirable characteristics. For example, aluminum is a good energy absorber, as is magnesium or lead. The embodiments limit the material choices for the lamination layers or the manufacturing method in obtaining a layer. The use of two or more layers provides advantages over single-wall, monolithic gun designs. Wrapping designs and fabrication techniques allow far greater numbers of metals and non-metallic materials to be used as lamination layers, thereby achieving cost savings and reducing production and fabrication times. Improved rupture protection can be achieved without increasing the weight or cost.

Each layer can be sleeved into the preceding layer. Each layer includes an impact strength sufficient to maintain the structural integrity without substantially splitting. For example, the third layer can be added to add thickness to the gun wall so the gun can withstand greater hydrostatic pressure and internal detonation pressures from larger charge, such as up to a 39 gram RDX™ charge for a 4-inch diameter well bore. As another example, a fourth layer can be added to assist with pressures from deep water drilling layers, such drilling depths up to 30,000 feet.

In another variation, layers can be made of the same material but oriented differently to achieve the desired properties, similar to the mutually orthogonal layering of plywood. One further variation can be implemented by offsetting a seam of each layer in the manufacturing process by rolling flat material into a tubular shape. One further variation can include an inner layer of high-strength material, such as the high-strength, alloy metals currently used for guns, and an outer tube of mild steel.

The interface of the surfaces of the layers need not be bound or otherwise mechanically attached together. The layers may be seamless or rolled. An advantage to this design is the simplicity and ease of manufacture. Each of the layers can have different chemical and/or mechanical characteristics, depending on the performance needs of the perforation work. Alternatively, each layer can be made of the same material. The present embodiments allow wall thickness and composition to become design variables that reduce the need for mill runs or large quantities of material.

One of the layers can be an energy absorbing layer disposed between any two layers of the gun wall. The energy absorbing layer can be a perforated sheet or can be a solid sheet. If the energy absorbing layer is a solid sheet, the solid sheet can comprise lead, magnesium, copper, aluminum, and alloys thereof and a non-metallic substance, such as a ceramic, paper, cardboard, or a pressure laminate composite. If a perforated sheet is used, the energy absorbing layer can comprise lead, magnesium, copper, steel, stainless steel, aluminum, and alloys thereof. The density per inch for the perforated sheet is contemplated to be between 1 hole per square inch and 700 holes per square inch, wherein the diameter of the holes ranges between 0.020 inches and 1 inch.

The wall layers in the perforating gun walls can have the same or different thicknesses. For example, each layer can have a thickness of 0.120 inches or an outer layer can have a thickness of 0.120 inches and subsequent inner layers can have thicknesses of 0.095 inches, 0.095 inches, and 0.083 inches. The wall layers can be composed of durable metals, such as iron, or of alloys, such as a steel, or of durable composites. The gun wall can be suspended within the well bore by a hanger, such as a coil tube or a wire line.

Figure 3:
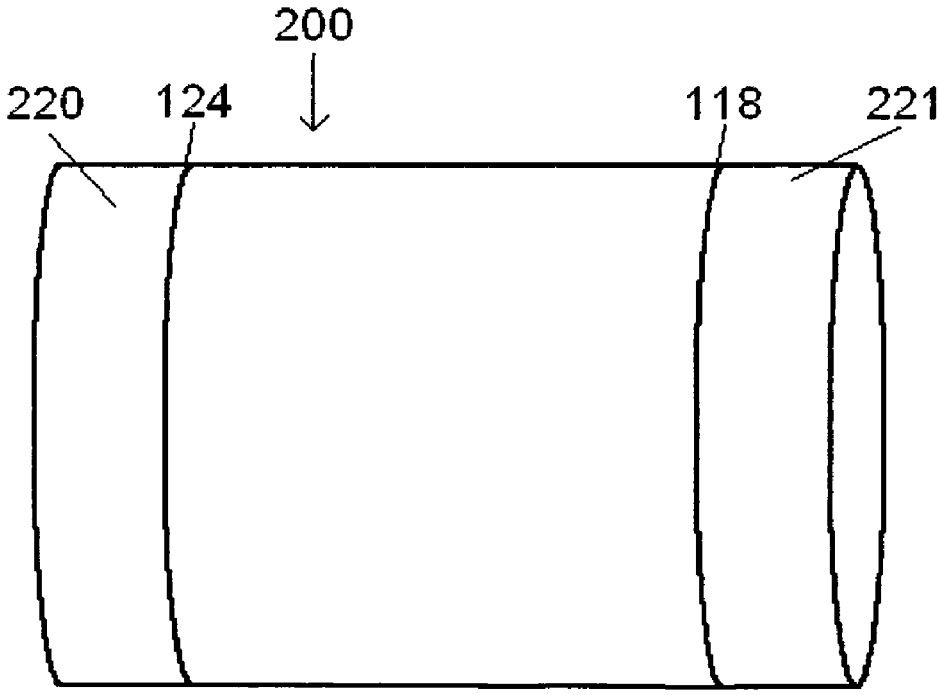
FIG. 3 depicts a side view of an embodiment of a perforating gun wall with end boxes.

FIG. 3 depicts another embodiment of the perforating gun wall 200. The perforating gun wall 200 can have a first box end 221 that is secured to the first end 124 of the sleeved assembly of the perforating gun wall 200. The perforating gun wall 200 can have a second box end 221 that is secured to the second end 118 of the sleeved assembly perforating gun wall 200. The box ends 220 and 221 can be solid cylinders, internally threaded to the sleeved assembly. The box end 220 and 221 can be affixed in other common manners, such as by welding the box ends 220 and 221 to the sleeved assembly. The box ends 220 and 221 can be attached in a combination, wherein the first box end 220 is connected by a threaded connection and the second box end 221 is connected by a welded connection.

The box ends 220 and 221 have the same outer diameter as the first layer. The box ends 220 and 221 can be made out of durable metals, including alloys of metal like steel.

Figure 4:
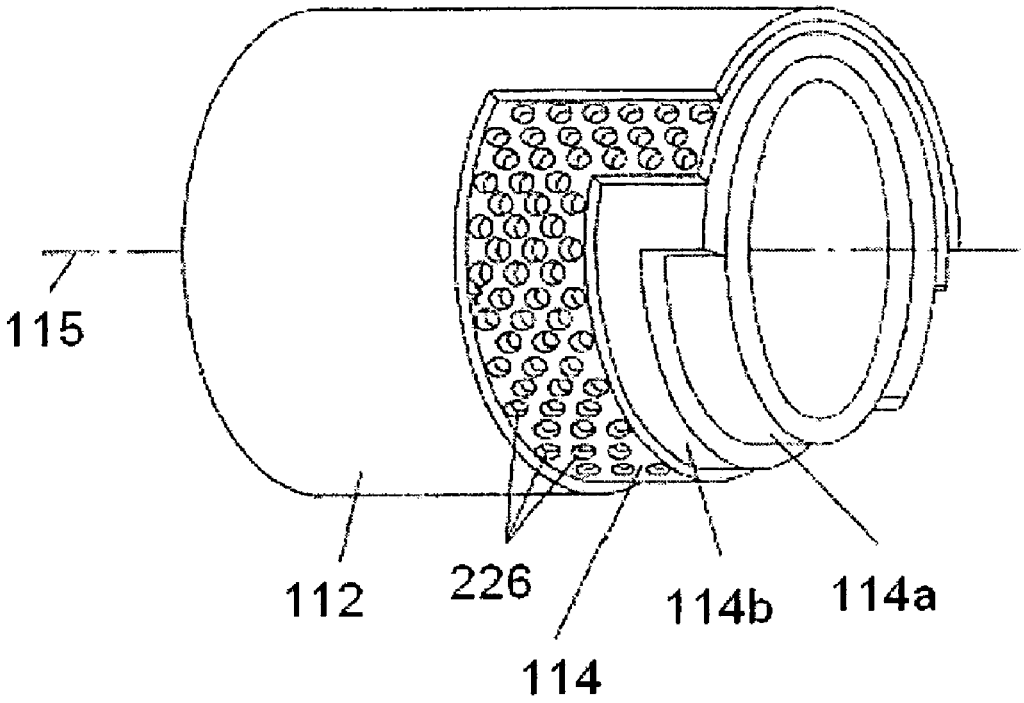
FIG. 4 depicts an embodiment of a perforating gun wall depicting numerous holes in the second layer.

FIG. 4 depicts an embodiment of multi-layered perforating gun wall 200 depicting numerous holes 226 in the second layer 114. The holes 226 are positioned to be aligned to the explosive charges located in the loading tube. In the depicted embodiment, the first (outer) layer 112 and the two most inner layers 114*a* and 114*b* are solid. Any or all of the inner layers can include one or more holes. The holes can have a diameter ranging from about 0.5 inches and 2 inches, but can be larger if necessary. The layer with the one or more holes can be composed of a metal; an alloy; bonded carbon fibers; a metal wire, such as 0.06 inches thickness; a woven stainless steel; a metal mesh, or combinations thereof.

Figures 5A, 5B:
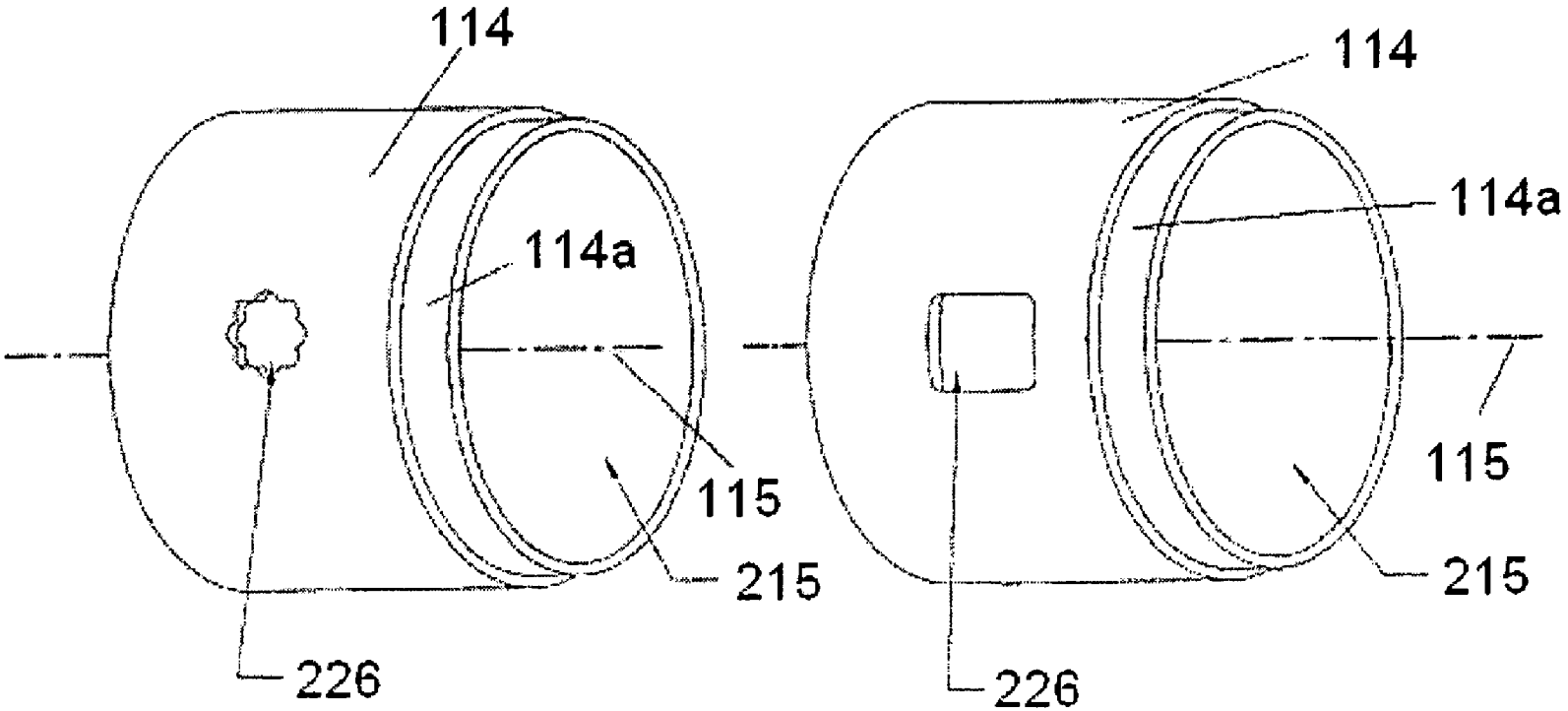
FIG. 5*a* and FIG. 5*b* illustrate holes in an inner layer with a predefined complex shape.

The holes can be circular, as depicted in FIG. 4, or can have other shapes as depicted in FIG. 5*a* and FIG. 5*b*. FIG. 5*a* and FIG. 5*b* illustrate precut holes forming recesses in an inner layer 114 having predefined complex as an alternative to the circular shaped precut hole. Actual shape design of the holes 226 is unlimited since design is no longer restricted by conventional machining methods. Any combination between layers and any shape of holes can be easily produced by laser cutting, tube assembly or layer lamination, and any required material wrapping. The cutting of holes can be accomplished before assembly, thereby eliminating the need for machining.

The holes in the inner layer can be positioned in a variety of patterns. The hole patterns can be diagonal to the central axis 115, as depicted in FIG. 4. Alternatively, the hole patterns can be parallel or perpendicular to the central axis 115. The holes can be placed in a helical pattern on the layer relative to the longitudinal or central axis of the gun wall. The holes can be placed randomly through the inner layer.

The holes can be placed so that each aligns with a hole in a subsequent layer. FIG. 6 depicts an embodiment, wherein the holes in three inner layers 114, 114*a*, and 114*b* have been aligned to one anther around a radial axis 219. FIG. 6 depicts the embodiment, wherein each subsequent hole diameter is smaller along the radial axis 219 in the direction of the center. The diameter can be the same or vary. The radial axis 119 of the cavity can be aligned with an explosive charge. At the time of assembly, the cavity may be filled with an euctectic material or other material selected to provide strength at ambient conditions but disperse, vaporize or otherwise degrade with the rapid explosive energy pulse.

The ability to achieve aligned holes through multiple layers allows for a desired blast geometry to be achieved, thereby enhancing the efficiency of the explosive charge or otherwise impact the directionality of the charge. The ability to achieve aligned holes through multiple layers allows for an additional advantage of fewer "off-center" shot problems and better charge performance due to scallop wall orientation since the outer tube's recess can achieve a constant underlying wall thickness regardless of the explosive jet exit point.

FIG. 7 illustrates the embodiment of the layers 112, 114, 114*a*, and 114*b* comprising a machined recess. Unlike the prior art technology of milling scallops into solid monolithic tube wall, the radial orientation of the recess side wall formed by the invention can be maintained constant to a point on the longitudinal axis. The cut hole results in a removal of an arc segment from the circumference of the layer or tube wall. The angle can be varied by the length of the arc segment cut relative to the diameter of the tube layer (or radial distance from the center axis of the gun). The angle can facilitate the accuracy or efficiency of the explosive charge. This angle can minimize interference or disruption of the explosive gas jet from the annulus 215 through the gun toward the casing and strata. The prior art scallops generally have a fixed orientation to the center axis of the scallop. This fixed dimension creates a non uniform orientation to the center axis of the gun or the explosive charge positioned within the annulus 215 and proximate to the center axis.

Perforating gun wall sleeve assemblies are typically produced in increments of five feet, with the most common gun being about twenty feet. Sleeved assembly can be constructed in lengths ranging from about five feet to about forty feet.

The perforating gun wall sleeve assemblies can hold and fire as many as twenty-one charges for every foot of gun length. Perforation jobs may require multiple combinations of 20-foot sections, which are joined together end to end and by threaded screw-on connectors. The present embodiments contemplate that at least two of the novel perforating gun wall sleeve assemblies can be connected together, such as with seals, threaded connections or a similar securing devices.

The charges typically include an explosive charge, a shape charge body, a primer vent, and a retainer cone. Differing well conductions, casings, strata, and so on create the need for varying configurations and properties of the loading tubes, charges, and mounting hardware. The detonated charge produces a high-energy explosive gas jet. The duration of the explosive event is only of an extremely small fraction of a second and can be considered to be an explosive pulse occurring at detonation. During the violent and explosive energy pulse, the charge casing, loading tubes, and other gun components are subjected to an immediate, non-uniform change in pressure and temperature. A detonation cord ignites the explosion at the primer vent within the non-combusting shaped charge body. The entire explosion within the charge ignites nearly instantaneously. Ignition within the shaped charge focuses an explosive jet of expanding hot gas radially outward toward the gun wall. The gun wall proximate to the short duration explosive jet or energy pulse contains a machined recess or scallop. The explosive jet perforates through the machined scalloped gun wall and continues through the narrow space between the gun wall and the well casing. The explosive jet energy perforates the well casing as well. The energy of the jet creates one or more shock waves that fracture the geologic formation. The amount of energy required to penetrate the gun body is reduced by the thickness provided by the scallops.

The design criteria specified by the present embodiments can be used to create an alternative gun tube construction that eliminates many of the problems and costs of the heavy walled tubing currently used. Although multiple embodiments of new gun material selection and construction are within the scope of this invention, attention should be first directed to the design and fabrication of gun tubing utilizing multiple layers of material. This method includes fabrication by layering or lamination of materials around a radius encompassing the longitudinal axis of the gun tube. The gun is designed with an improved ability to withstand high shocks delivered over very short periods of time ("impact strength") created by the simultaneous detonation of multiple explosive charges ("explosive energy pulse" or "pulse"). In essence, the impact strength normally associated with steels with 200 low carbon content and/or higher levels of other alloying elements, such as chromium and nickel is improved by using the design features of the invention.

The ability of the gun to withstand the shock of the explosion from the gun by enabling the gun wall to transfer its energy immediately to the outside surface of the tubing quickly and smoothly has been improved. The present embodiments reduce imperfections in the gun wall which can act as stress risers and initiate cracking and failure.

While this invention has been described with emphasis on the embodiments, it should be understood that within the scope of the appended claims the invention might be practiced other than as specifically described herein.

What is claimed is:

1. A perforating gun wall that withstands short, high energy pulses of an explosion originating within a loading tube comprising a plurality of explosive shaped charges, wherein the wall comprises:

a. a first layer with a first impact strength sufficient to maintain the structural integrity of the gun wall without splitting due to the explosion;

b. a second layer with a second impact strength sufficient to maintain the structural integrity of the gun wall without substantially splitting due to the explosion, wherein the second layer is sleeved within the first layer forming a sleeved assembly, and wherein one layer is maintained as a solid layer without holes and the other layer comprises at least one hole aligned with at least one explosive shaped charge, and wherein the first and second layers comprise a defined material property that reduces occurrences of catastrophic failure, and wherein the defined material property comprises:

i. a tensile strength;

ii. ductility;

iii. elasticity;

iv. shock absorption;

v. a thermal expansion coefficient;

vi. a melting temperature;

vii. a vaporization temperature; and c. wherein the second layer is sleeved over a third layer and the third layer has an impact strength sufficient to maintain the structural integrity of the gun wall without substantially splitting due to the explosion.

2. The perforating gun wall of claim 1, wherein the first layer extends beyond the second layer forming an extension, wherein the interior of the extension comprises a threaded portion.

3. The perforating gun wall of claim 1, further comprising a first box end secured to a first end of the gun wall; and a second box end secured to a second end of the gun wall.

4. The perforating gun wall of claim 1, wherein the first layer is slip fit over the second layer.

5. The perforating gun wall of claim 1, wherein the first layer comprises a different thickness than the second layer.

6. The perforating gun wall of claim 1, wherein each layer is composed of a metal, an alloy, or a composite.

7. The perforating gun wall of claim 1, further comprising additional layers sleeved within a preceding layer, wherein each of the additional layers has an impact strength sufficient to maintain the structural integrity without substantially splitting.

8. The perforating gun wall of claim 7, wherein the first layer is a solid layer without holes and at least one of the other layers comprises at least one hole with a diameter from about 0.5 inches to about 2 inches.

9. The perforating gun wall of claim 1, wherein each layer with at least one hole is composed of a material selected from the group consisting of a metal, an alloy, a bonded carbon fibers, or metal wire, a woven stainless steel, a metal mesh, and combinations thereof.

10. The perforating gun wall of claim 1, wherein the at least one hole is disposed in a pattern selected from the group consisting of a helical pattern relative to the longitudinal axis, a right angle pattern at right angles to the longitudinal axis, and combinations thereof.

11. The perforating gun wall of claim 1, wherein at least two holes comprise different diameters.

12. The gun wall of claim 1, wherein the first layer comprises a machined recess aligned with an explosive shaped charge.

13. The gun wall of claim 1, wherein the sleeved assembly is from about 1 foot to about 40 feet in length.

14. A perforating gun having a longitudinal axis comprising:

a. a loading tube comprising a plurality of explosive shaped charges;

b. a gun wall disposed on the loading tube forming an intermediate gun assembly having a first assembly end and a second assembly end, wherein the gun wall comprises:

c. a first layer with a first impact strength sufficient to maintain the structural integrity of the gun wall without splitting;

d. a second layer with a second impact strength sufficient to maintain the structural integrity of the gun wall without substantially splitting, wherein the second layer is sleeved within the first layer forming a sleeved assembly, and wherein one layer is maintained as a solid layer and the other layer comprises at least one hole aligned with at least one explosive shaped charge, and wherein the first and second layers comprise a defined material property that reduces occurrences of catastrophic failure, and wherein the defined material property comprises:

i. a tensile strength;

ii. ductility;

iii. elasticity;

iv. shock absorption;

v. a thermal expansion coefficient;

vi. a melting temperature; and vii. a vaporization temperature;

e. wherein the second layer is sleeved over a third layer and the third layer has an impact strength sufficient to maintain the structural integrity of the gun wall without substantially splitting due to the explosion;

f. a first box end secured on the first assembly end; and g. a second box end secured on the second assembly end.

15. The perforating gun of claim 14, wherein the at least one hole comprises a diameter from about 0.5 inches to about 2 inches.

16. The plurality of holes of claim 14, wherein the at least one hole is disposed in a pattern selected from the group consisting of a helical pattern relative to the longitudinal axis, a right angle pattern at right angles to the longitudinal axis, and combinations thereof.

17. The perforating gun of claim 14, wherein at least two holes comprise different diameters.

18. The perforating gun of claim 14, wherein the perforating gun is from about 1 foot to about 40 feet in length.

* * * * *